US005660566A

United States Patent [19]

Ohsumi

[11] Patent Number: 5,660,566

[45] Date of Patent: Aug. 26, 1997

[54] WATERPROOF PLUG FOR CONNECTOR

[75] Inventor: Hideki Ohsumi, Shizuoka-ken, Japan

[73] Assignee: Yazaki Corporation, Tokyo, Japan

[21] Appl. No.: 365,075

[22] Filed: Dec. 28, 1994

[30] Foreign Application Priority Data

Dec. 29, 1993 [JP] Japan ..... 5-352326

[51] Int. Cl.[6] ..... H01R 13/40

[52] U.S. Cl. ..... 439/587; 439/275

[58] Field of Search ..... 439/587, 274, 439/275, 865, 866, 867, 868

[56] References Cited

U.S. PATENT DOCUMENTS 4,391,483 7/1983 Desourteaux ..... 439/275
5,224,875 7/1993 Watanabe et al. ..... 439/587

*Primary Examiner*—David L. Pirlot
*Assistant Examiner*—Eugene G. Byrd
*Attorney, Agent, or Firm*—Wigman, Cohen, Leitner & Myers, P.C.

[57] ABSTRACT

A waterproof plug (30) fitted to an outer circumference of a wire (9) and inserted into a terminal insertion cavity (10*a*) of a connector housing (10) for sealing a space between the wire and the connector housing comprises an elastic cylindrical body (2) formed with: an inner corrugated sealing portion (3) for sealing the outer circumference of the wire; an outer corrugated sealing portion (4) for sealing the inner circumference of the terminal insertion cavity (10*a*) of the connector housing (10); and, in particular, a press portion (31) expanding radially outward at a free end of the elastic cylindrical body, the press portion being sufficiently deformable radially inward gradually against the wire, when the elastic cylindrical body (2) is being inserted into the terminal insertion cavity of the connector housing. The press portion (31) is preferably divided into a plurality of separated press portions (31*d*) with a space interposed between the two adjacent separated press portions (31*d*) for providing an easy deformation of the separated press portions into the spaces, respectively. The waterproof plug thus constructed is excellent in both the wire insertion and sealing characteristics.

3 Claims, 3 Drawing Sheets

WATERPROOF PLUG FOR CONNECTOR

BACKGROUND OF THE INVENTION

1. Technical Field

The present invention relates to a waterproof plug used for an electric connector to prevent water from entering into a connector housing through a space between a wire connected to a terminal and a connector housing.

2. Description of the Related Art

An example of related art waterproof plug used for a connector is disclosed in Japanese Published Unexamined Utility Model Application No. 62-163879.

A related art waterproof plug formed of rubber has a cylindrical body portion with a wire insertion hole. Further, the waterproof plug is formed with an inner corrugated sealing portion brought into tight contact with the outer circumference of a wire and an outer corrugated sealing portion brought into tight contact with the inner circumference of a terminal insertion cavity of a connector housing. Further, the waterproof plug is formed with a cylindrical clamped portion on the front side of the body portion in such a way that a clamping recessed portion is formed on the outer circumference of the clamped portion. Furthermore, a tapered portion is formed at the inner rear end circumference of the body portion for facilitating the insertion of the wire into the waterproof plug.

To use this waterproof plug, the waterproof plug is first fitted to the outer circumference of the wire coating material of the wire and then pushed into the rear end of the terminal (to which an end of a conductor of the wire has been clamped). Further, a clamping piece of the terminal is clamped against the recessed portion of the waterproof plug to fix the waterproof plug to the terminal. Under these conditions, the terminal is inserted into the terminal insertion cavity of the connector housing. Therefore, it is possible to fit the terminal into the connector housing under waterproof conditions.

In the related art waterproof plug as described above, however, whenever the wire is moved or pulled in radial detections, since the waterproof plug is easily deformed radially outward by the wire, there exists a problem in that the sealing characteristics deteriorate both at the sealing portion between the waterproof plug and the wire and at the sealing portion between the waterproof plug and the connector housing. To improve the sealing characteristics, when the diameter of the wire insertion hole of the waterproof plug is reduced, there arises another problem in that the wire cannot be inserted into the waterproof plug easily.

SUMMARY OF THE INVENTION

With these problems in mind, therefore, it is the object of the present invention to provide a waterproof plug compatible with both the sealing and wire insertion characteristics.

To achieve the above-mentioned object, the present invention provides a waterproof plug fitted to an outer circumference of a wire (9) and inserted into a terminal insertion cavity (10*a*) of a connector housing (10) for sealing a space between the wire and the connector housing, and having an elastic cylindrical body (2) formed with: an inner corrugated sealing portion (3) for sealing the outer circumference of the wire; an outer corrugated Sealing portion (4) for sealing the inner circumference of the terminal insertion cavity (10*a*) of the connector housing (10); and a press portion (31) expanding radially outward at a free end of the elastic cylindrical body, the press portion being sufficiently deformable radially inward gradually against the wire, when the elastic cylindrical body (2) is being inserted into the terminal insertion cavity of the connector housing.

Further, it is preferable that the press portion (31) is divided into a plurality of separated press portions (31*d*) with a space interposed between the two adjacent separated press portions to allow each separated press portion to be deformable into each space in a stable manner. Further, each of the separated press portions (31*d*) is formed into a fan-shape when seen along an axial direction of the waterproof plug. Further, a plurality of separated press portions (31*d*) are linked with each other by a thin-wall circular connection piece (33) so as to provide an annular cylindrical body (2).

In the waterproof plug according to the present invention, since the elastic cylindrical body is formed with the press portion expanding radially outward being opened at the free end thereof, the wire can be inserted easily into the central wire insertion hole of the waterproof plug. Further, since the press portion is deformed gradually when the waterproof plug is being inserted into the terminal insertion cavity of the connector housing, the wire can be sealed tightly by the deformed press portion. Accordingly, even if the wire is moved radially, it is possible to retain an excellent sealing characteristics of the waterproof plug between the wire and the connector housing.

Further, since the press portion is divided into a plurality of separated press portions, and in addition since each space is provided between the two adjacent separated press portions, the press portion can be deformed easily and stably into the spaces under well balanced conditions, so that it is possible to improve both the sealing and insertion characteristics of the waterproof plug with respect to the wire and the connector housing. Further, since the deformation rate can be increased owing to the presence of the space between the two adjacent separated press portions, a small diameter wire can be also sealed securely. Further, since the separated press portions are connected to each other via the thin-wall circular connection pieces, the waterproof plug is easy to handle.

BRIEF DESCRIPTION OF THE DRAWINGS

FIG. 1(*b*) is a front view obtained when seen from the arrow direction A —A in FIG. 1(*a*);

DETAILED DESCRIPTION OF THE EMBODIMENTS

With reference to the attached drawings, an embodiment of the waterproof plug according to the present invention will be described hereinbelow.

Figure 1A:
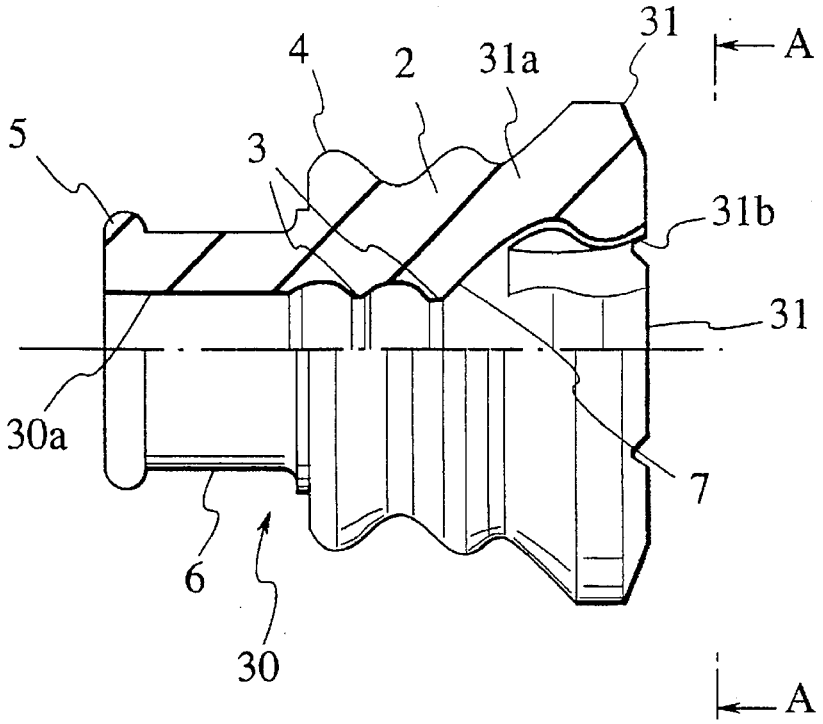
FIG. 1(*a*) is a side, partially cross-sectional view showing an embodiment of the waterproof plug according to the present invention.
Figure 1B:
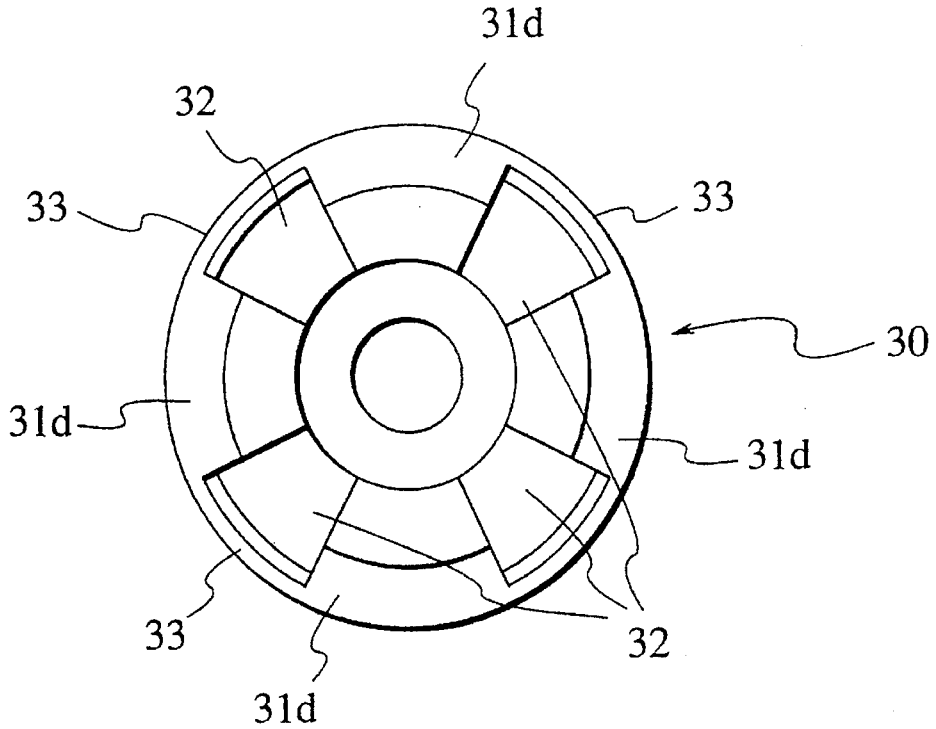

In FIGS. 1(*a*) and (*b*), a waterproof plug 30 is formed into a cylindrical shape and formed of rubber. The waterproof plug 30 has a cylindrical body portion 2 with a wire insertion hole 30*a* at the central portion thereof. Further, the waterproof plug 30 is formed with an inner corrugated sealing portion 3 brought into tight contact with the outer circumference of a wire 9 (see FIG. 2) and an outer corrugated sealing portion 4 brought into tight contact with the inner circumference of a terminal insertion hole 10*a* of a connector housing 10 (see FIG. 2). Further, the waterproof plug 30 is formed with a cylindrical clamped portion 5 on the front side of the body portion 2 in such a way that a clamping recessed portion 6 is formed on the outer circumference of the clamped portion 5. Furthermore, a tapered portion 7 is formed at the inner rear end circumference of the body portion 2 for facilitating the insertion of the wire 9.

Being different from the related art waterproof plug, the waterproof plug 30 of the present invention comprises a press portion 31 divided into four separated press portions 31*d* formed integral with the body portion 2 at the rear end thereof and arranged at regular angular intervals in the circumferential direction thereof in such a way as to surround the wire 9. Each separated press portion 31*d* is formed into a fan-shape, and a fan-shaped space 32 of a predetermined size is provided between two adjacent separated press portions 31*d*. Each separated press portion 31*d* is linked with the body portion 2 through a slightly thin-wall cylindrical radially bent portion 31*a*. Therefore, each separated press portion 31*d* can be deformed easily inward of the body portion 2 into the fan-shaped space 32 formed between the two adjacent separated press portions 31*d*. Under free conditions, the press portion 31 is formed so as to be opened radially outward. Each press portion 31*d* is formed into a roughly circular arc shape in cross section, and formed with an inwardly expanding portion 31*b* in the inner circumferential surface thereof to increase the tightness against the wire 9. Each space 32 arranged between the two adjacent separated press portions 31*d* serves as a space into which each separated press portion 31*d* can be deformed radially inward. The four separated press portions 31*d* arranged with the space 32 interposed therebetween are connected to each other by a thin-wall circular connection piece 33 formed at the outermost circumference of the body portion 2, so that these separated press portions 31*d* can be connected as an annular cylindrical body 2.

The function of the waterproof plug 30 according to the present invention will be described hereinbelow.

Figure 2:
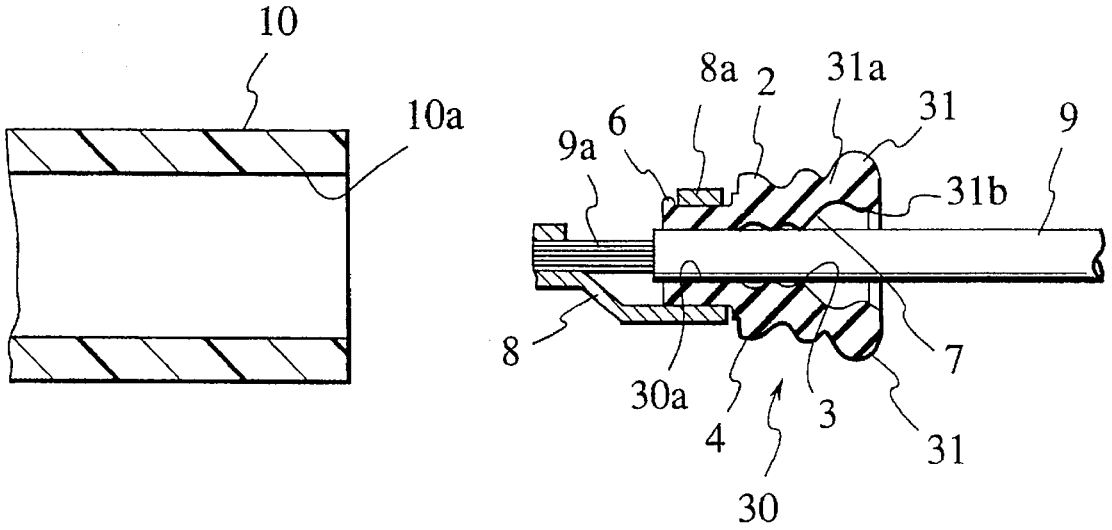
FIG. 2 is a cross-sectional view for assistance in explaining the state before the waterproof plug shown in FIG. 1(*a*) is inserted into the connector housing.

To use the waterproof plug 30, first a wire 8 is passed through the central wire insertion hole 30*a* of the waterproof plug 30. In this stage, since the four separated press portions 31*d* are all opened radially outward, it is possible to easily pass the wire 9 through the central wire insertion hole 30*a* of the waterproof plug 30. After that, as shown in FIG. 2, the waterproof plug 30 (to which the wire has been passed) is placed at the rear end of a terminal 8. After an end conductor 9*a* of the wire 9 is fixed to the terminal 8, a clamping piece 8*a* of the terminal 8 is clamped to the clamping recessed portion 6 of the waterproof plug 30 to fix the waterproof plug 30 to the terminal 8. Under these conditions, the terminal 8 is inserted into a terminal insertion cavity 10*a* of a connector housing 10.

When the terminal 8 is being inserted into the terminal insertion cavity 10*a* of the connector housing 10, since the separated press portions 31*d* of the waterproof plug 30 are brought into contact with the inner wall of the terminal insertion cavity 10*a* of the connector 10, the separated press portions 31*d* are deformed gradually inward.

Figure 3:
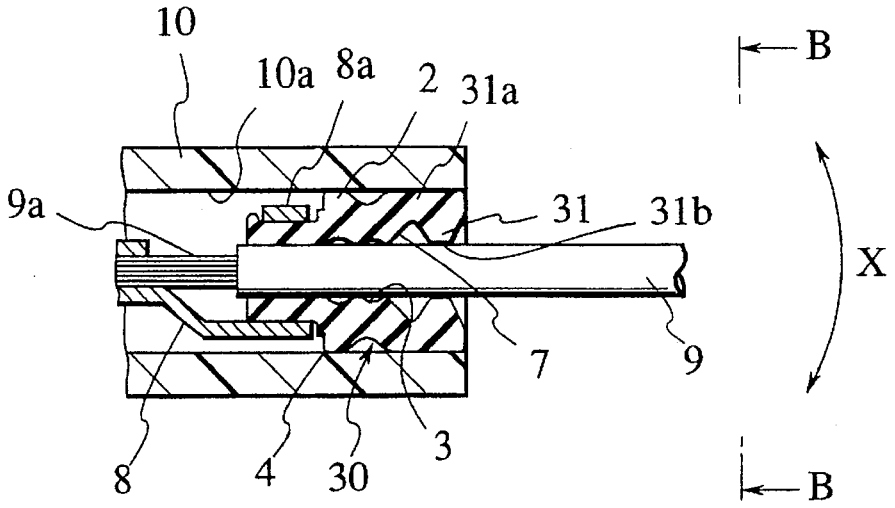
FIG. 3 is a cross-sectional view for assistance in explaining the state after the waterproof plug shown in FIG. 1(*a*) has been inserted into the connector housing.
Figure 4:
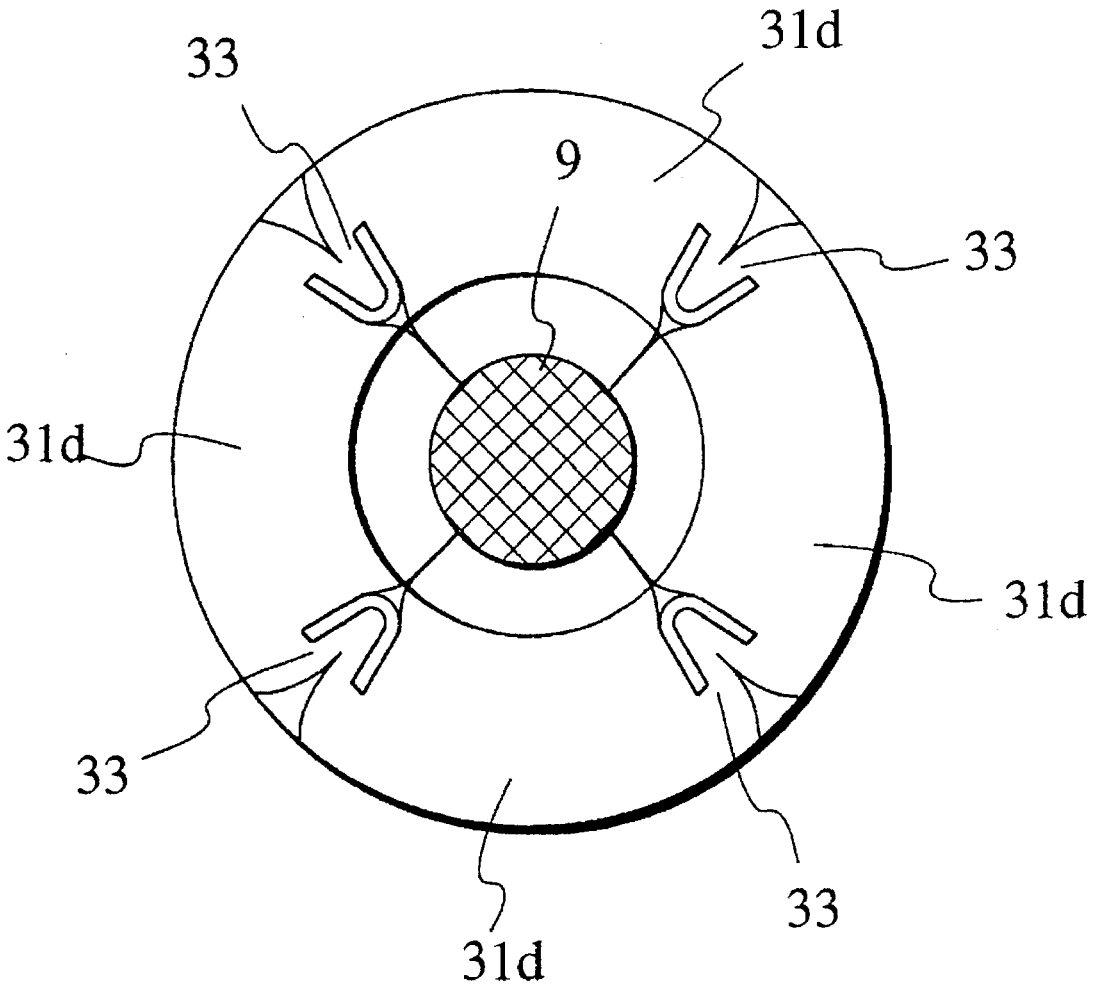
FIG. 4 is a front view obtained when seen from the arrow direction B—B in FIG. 3.

With the advance of the insertion of the waterproof plug 30 into the connector housing 10, as shown in FIGS. 3 and 4, the separated press portions 31*d* deformed inward are brought into tight contact with the outer circumference of the cover material of the wire 9 by pressing the wire 9 from the outer circumferential sides thereof. In this deformation process of the separated press portions 31*d*, the separated press portions 31*d* can be deformed easily into the spaces 32 formed therebetween, respectively. In this case, the thin-wall circular connection pieces 33 can also be easily deformed into the spaces 32, respectively. In summary, since there exists the space 32 between the two adjacent separated press portions 31*d* to more, it is possible for the separated press portions 31*d* easily inward into the spaces 32, respectively.

As described above, after the waterproof plug 30 has been inserted into the terminal insertion cavity 10*a* of the connector housing 10, since the wire 9 is pushed from the outer circumferential surface side thereof tightly by the waterproof plug 30, even if the wire 9 is moved in an arrow direction X in FIG. 3, it is possible to support the bent wire 9 firmly, so that the sealing portions 3 and 4 will not be deformed outwardly, and thereby the sealing characteristics can be maintained.

Further, in this embodiment, since the fan-shaped separated press portions 31*d* are used, it is possible to increase the inward deformation rate of the respective separated press portions 31*d*. Therefore, even if the diameter of the wire 9 is small, it is possible to maintain an excellent sealing characteristics between the waterproof plug 30 and the wire 9. Further, since the separated press portions 31*d* are connected to each other by the thin-wall connecting pieces 33, respectively, it is possible to prevent the separated press portions 31*d* from being separated individually. Further, there exist various advantages such that the wire 9 can be passed easily through the wire insertion hole 30*a* of the waterproof plug 30; the separated press portions 31*d* are arranged and deformed under well balanced conditions; and the wire 9 can be pressed stably from the outer circumference thereof.

Further, in the above-mentioned embodiment, the number of the separated press portions 31*d* is four. Without being limited only thereto, however, it is possible to increase or decrease the number of the separated press portions 31*d*. Further, it is not necessary to clearly divide the press portion 31, as far as the individual separated press portions 31*d* can be deformed inward into the spaces 32, respectively, when the wire 9 is being inserted into the terminal insertion cavity 10*a* of the connector housing 10.

As described above, in the waterproof plug 30 according to the present invention, when the wire 9 is passed therethrough, since the separated press portions 31*d* of the waterproof plug 30 are opened radially outward, the wire 9 can be passed through the waterproof plug 30 easily, thus improving the wire insertion characteristics through the waterproof plug. On the other hand, when the waterproof plug 30 is inserted into the terminal insertion cavity 10*a* of the connector housing 10, since the wire 9 can be pressed by a sufficiently strong elastic force of the separated press portions 31*d*, it is possible to securely push the wire 9 from the outer circumferential side thereof at the rear portion of the waterproof plug 30, so that it is possible to improve the sealing characteristics of the waterproof plug 30 even if the wire 9 is moved outwardly.

What is claimed is:

1. A waterproof plug fitted to an outer circumference of a wire and inserted into a terminal insertion cavity of a connector housing for sealing a space between the wire and the connector housing, said plug having an elastic cylindrical body comprising:

an inner corrugated sealing portion for sealing the outer circumference of the wire;

an outer corrugated sealing portion for sealing the inner circumference of the terminal insertion cavity of the connector housing; and a press portion expanded radially outward at a free end of the elastic cylindrical body, the press portion being deformable radially inwardly against the wire when the elastic cylindrical body is inserted into the terminal insertion cavity of the connector housing;

wherein the press portion is divided into a plurality of separated press portions with a space interposed between each two adjacent separated press portions to allow each separated press portion to be deformable into each space in a stable manner.

2. The waterproof plug of claim 1, wherein each of the separated press portions is formed into a fan shape when seen along an axial direction of the waterproof plug.

3. The waterproof plug of claim 1, wherein said separated press portions are linked with each other by a thin-wall circular connection piece so as to provide an annular cylindrical body.

* * * * *